United States Patent [19]

Lind

[11] Patent Number: 4,780,181

[45] Date of Patent: Oct. 25, 1988

[54] METHOD OF WASHING DELIGNIFIED PULP IN A CONTINUOUS PULP COOKING PRESSURE VESSEL

[75] Inventor: Lennart G. Lind, Grums, Sweden

[73] Assignee: Billerud Aktiebolag, Saffle, Sweden

[21] Appl. No.: 81,521

[22] Filed: Aug. 3, 1987

Related U.S. Application Data

[63] Continuation of Ser. No. 701,359, Feb. 13, 1985, abandoned.

[30] Foreign Application Priority Data

Feb. 22, 1984 [SE] Sweden ..... 8400963

[51] Int. Cl.[4] ..... D21C 7/14; D21C 9/04

[52] U.S. Cl. ..... 162/17; 162/37; 162/60

[58] Field of Search ..... 162/19, 60, 41, 251, 162/17, 37; 68/181 R; 8/156

[56] References Cited

U.S. PATENT DOCUMENTS

| | | | |
|---|---|---|---|
| 3,303,088 | 2/1967 | Gessner | 162/60 |
| 3,445,328 | 5/1969 | Laakso | 162/19 |
| 4,276,167 | 6/1981 | Richter et al. | 162/242 |

*Primary Examiner*—Steve Alvo

*Attorney, Agent, or Firm*—Armstrong, Nikaido, Marmelstein & Kubovcik

[57] ABSTRACT

A method in connection with continuous pulp cooking to wash the delignified pulp in a vertical, elongated pressure vessel comprising a cooking zone (1), a main washing zone (3) and a conditioning zone (4) at the bottom of the vessel, where the pulp is further washed and optionally diluted and cooled, said cooking zone being separated from said main washing zone by an interruption zone (2), where diluting/washing liquid displaces the cooking liquor, which is drained via one or several interruption circulation screen girdles (5), while contaminated washing liquid in the conditioning zone is displaced by cleaner washing liquid and is drained via one or several bottom screen girdles (10). At least part of that washing liquid which has been drained through the bottom screen girdle/s/ (10) is passed in countercurrent to, but not through, the pulp, i.e. not in contact with the pulp, but through at least one separate countercurrent conduit (17) up to at least one intermediate screening stage (14) between the interruption zone and the conditioning zone, where it enters the pulp centrally and spreads outwards to displace contaminated diluting/washing liquid, which is drained through one or several intermediate screen girdles (15).

6 Claims, 2 Drawing Sheets

METHOD OF WASHING DELIGNIFIED PULP IN A CONTINUOUS PULP COOKING PRESSURE VESSEL

This application is a continuation of Ser. No. 701,359, filed Feb. 13, 1985, now abandoned.

TECHNICAL SCOPE

The invention concerns a method for washing delignified pulp, in connection with continuous cooking, in a vertical elongated pressure vessel, comprising a cooking zone, a main washing zone, and a conditioning zone at the bottom of the vessel, where the pulp is further washed and possibly cooled, the cooking zone being separated from the main washing zone by an interruption zone in which washing liquid displaces the cooking liquor, the cooking liquor draining through one of several interruption circulation girdles, while contaminated washing liquid in the conditioning zone is displaced by cleaner washing liquid and drains through one or several bottom screen girdle. The invention concerns also equipment with which to implement this method.

BACKGROUND ART

Wood pulp is normally cleaned by letting the washing liquid pass the pulp in counter-current flow, in other words so that the pulp fibres meet progressively cleaner washing liquid as it progresses through the washing device, in order to obtain the best possible washing effect. This is the basic principle in connection with both separate washing devices and continuous washing devices, integrated in a continuous cooking device. This latter technique is described e g in "Continuous Pulping Processes" by Sven Tydholm, pp 173–178.

When the washing device is separate, counter-current flow has no draw-backs, but there are certain specific problems in connection with counter-current flow when the washing is carried out as a final operation in a continuous pulp digester. Thus, the upward flow of the washing liquid slows down the fiber mass and consequently the downward feed of the chip column above. When the production rate and/or the dilution rate is great, sometimes the chip column does not flow downward smoothly under the influence of gravity but jams. Hence, counter-current washing may cut the maximum capacity of the integrated device by 20–30%, which must be considered a serious drawback of counter-current washing. As a consequence, the normal maximum production rate is not greater than 25–30 tons per day per square meter in a continuous pulp digester with counter-current washing. Otherwise the chip column jams, the production rate becomes uneven, and consequently the product quality is lowered, the yield decreases and the washing becomes less efficient.

BRIEF DESCRIPTION OF THE INVENTION

The object of the invention is to eliminate or at least substantially reduce the problems stated above, primarily to increase the maximum possible production rate of the existing continuous pulp digester, and to obtain a smoother run by eliminating the chip column jams, thereby also providing for a more even product quality which may permit an increased kappa number and yield. Yet another object is to provide for efficient and stable washing over a broad production rate interval.

These and other objects may be realized by letting washing liquid which has been drained through the bottom screen girdle/s to flow counter-current-wise, but not through the pulp, in other words not in contact therewith but rather through at least one separate counter-current conduit up to at least one intermediate screening stage between the interruption zone and the conditioning zone, where it enters centrally in the pulp and spreads radially outwards and displaces contaminated diluting washing liquid which in turn is drained through one or several intermediate screen girdles.

It is especially suitable when the production capactiy of the digester is to be at its maximum to let the diluting washing liquid accompany the pulp downwards co-current-wise toward said intermediate screening stage, and it is correspondingly suitable to let that washing liquid which enters the pulp at the intermediate screening stage accompany the pulp downwards toward the conditioning zone. Substantial improvements compared to conventional counter-current washing may however be obtained also be letting the washing liquid spread radially outwards toward the screen girdles, the liquid column in the washing zone being substantially stationary, and even if a certain amount of washing liquid is pressed upwards in counter-current flow through the pulp major improvements may be obtained in comparision with conventional counter-current washing, where all washing liquid flows upwards throug the pulp as the pulp advances downwards.

It must be realized that the process and the equipment according to the invention does not exclude the provision of more than one intermediate screening stage between the interruption zone and the conditioning zone, in which case washing liquid which has been drained through the screen girdle/s/ of one intermediate stage is at least partly passed counter-current-wise but not through the pulp up to the intermediate stage above, where it is let in centrally in the pulp and spreads radially outwards.

The equipment according to the invention comprises at least one intermediate screening stage between the interruption zone and the conditioning zone, one or several screen girdles between the screening stage and a conduit to pass at least some of that washing liquid which drains from the bottom screen girdle/s/to said intermediate screening stage, said conduit opening centrally into the main washing zone, i e in the vicinity of the central axis of the device.

In case the equipment comprises two or more intermediate screening stages, a conduit is provided to pass washing liquid from the screen girdle/s/ of one intermediate screening stage to the intermediate screening stage above and opens centrally into the main washing zone.

Further characteristics and aspects as well as advantages of the invention will become apparent from the patent claims to follow and from the following description of two embodiments of the invention.

BRIEF DESCRIPTION OF DRAWINGS

In the following description of two preferred embodiments of the invention, reference will be made to the drawings attached, wherein.

The drawings only depict such details as are important to the principles of the invention, other parts being omitted. Hence, the drawings do not illustrate the design of the digester and nor do they show the conduits for supplying the digester with pulp, digesting fluid etc, since such parts belong to prior art and are not part of the invention.

DESCRIPTION OF PREFERRED EMBODIMENTS

Figure 1:
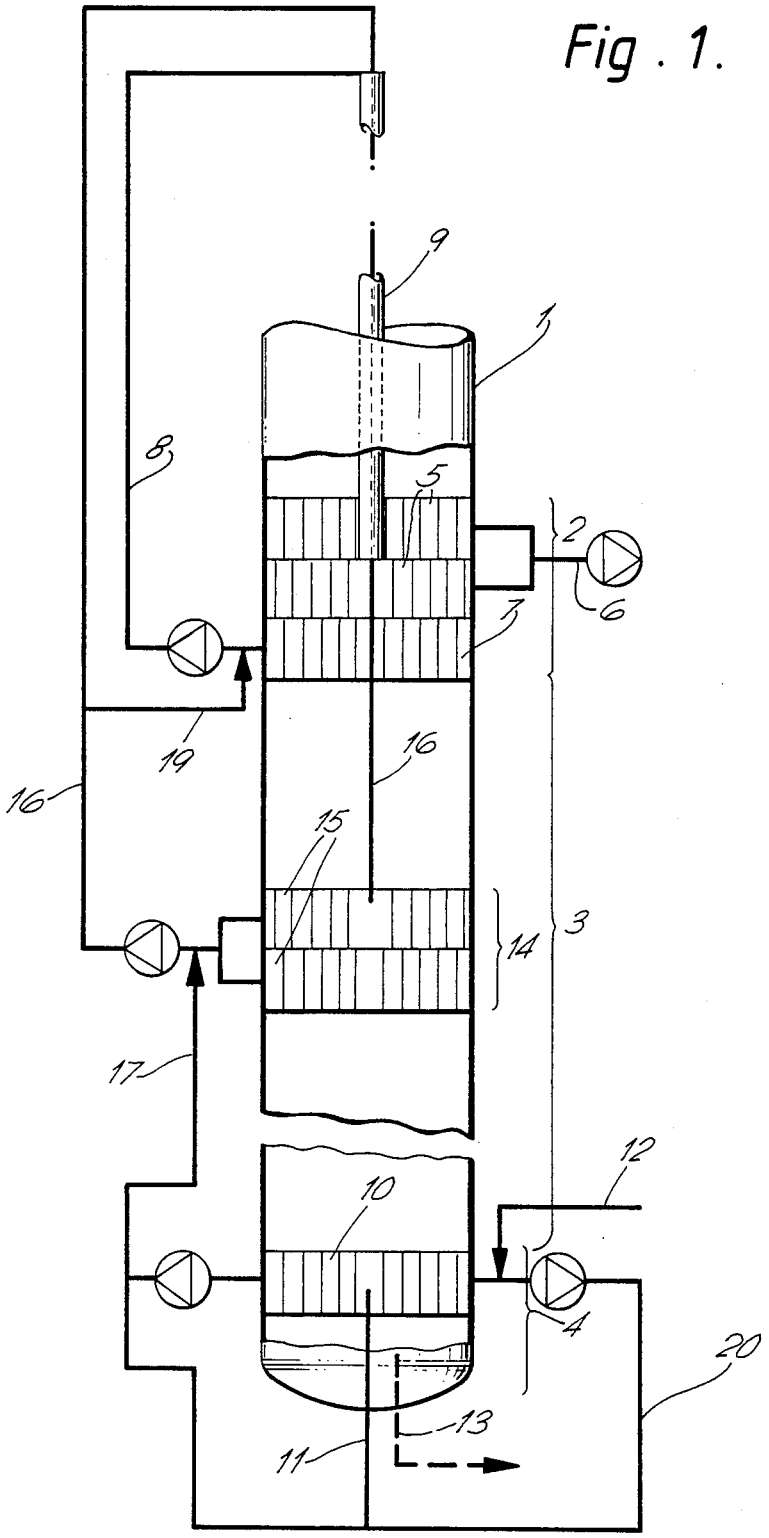
FIG. 1 is a diagrammatic vertical cross section of the equipment according to a first preferred embodiment of the invention.

Referring now to FIG. 1, the bottom part of continuous pulp digester is designated by numeral 1, an interruption zone by 2, a main washing zone by 3, and a conditioning zone by 4. The interruption zone 2 comprises a pair of upper screen girdles 5. Outside the screen girdles there are collecting room for spent cooking liquor, which is drained from the fibrous mass passing by the screen. The drained spent cooking liquor is passed via a conduit 6 to an evaporator plant and a recovery station for used chemicals. Below the screen girdles 5 there is another interruption circulation screen girdle 7. From the collecting room, not shown on the drawing, a conduit 8 extends upwards. The conduit 8 is connected to a central pipe 9 for supplying diluting liquid to the interruption zone 2.

The conditioning zone is designed as a conventional stage for circulatory washing, comprising a bottom screen girdle 10 for used washing liquid and a central pipe 11 supplying circulating washing liquid from the screen girdle 10 mixed with cleaner washing liquid supplied by a conduit 12 from a later washing filter. In this circulatory washing stage the pulp may be diluted to the desired concentration and cooled according to known art before draining through conduit 13.

The above is part of prior art. According to the invention, an intermediate screening stage 14 is arranged in the main washing zone 3 between the interruption zone 2 and the conditioning zone 4, comprising a couple of washing screens or intermediate screen girdles 15. A conduit 16 for the supply of washing liquid to the intermediate screening stage 14 extends down inside the pipe 9 and opens into the area of the intermediate screen girdles 15. The conduit 16 extends from the intermediate screen girdles 14, and to said conduit 16 is connected a conduit 17 supplying cleaner washing liquid from the circulation conduit 20. From the conduit 16 extends a branch conduit 19 over to conduit 8.

The equipment described functions as follows:

The cooked fibrous material in digester 1 is delignified when it has reached screen girdles 5. The digestion process is interrupted by supplying diluting or washing liquid to the pulp centrally via pipe 9. The diluting liquid displaces the cooking liquor, which passes through the screen girdles 5 and drains via conduit 6 to the evaporation and recovery stations. The diluting liquid is a mixture of recirculated liquid from the interruption circulation screen girdle 7 and cleaner washing liquid from the conduit 16 via branch conduit 19.

As the pulp passes down through the main washing zone 3 from the interruption zone 2 toward the intermediate screening stage 14 it is washed by continuous diffusion. At the level of the intermediate screening stage 14 the pulp encounters cleaner washing liquid, which is supplied centrally by conduit 16. This cleaner washing liquid is obtained by passing liquid up through conduit 17 from the bottom screening stage 10 to the conduit 16, i e in counter-current flow but out of contact with the pulp during this counter-current transport. The cleaner washing liquid supplied by conduit 16 spreads radially outwards through the pulp and displaces that washing liquid which has been contaminated in the diffusion process and presses it out through the intermediate screen girdles 15 from where it is recirculated after being mixed with cleaner washing liquid from the counter-current conduit 17.

The pulp continues downwards from the intermediate screening stage 14 through the main washing zone during continued washing by diffusion. In the conditioning zone further washing is done by adding cleaner washing liquid through the conduit 11 and draining spent washing liquid through conduit 20, concurrently with cooling and diluting the pulp to the desired concentration, before the pulp is let out through conduit 13.

By adjusting the flow rates in conduits 9, 16 and 11 the washing process may be controlled in such a way, according to the invention, that the washing liquid accompanies the pulp downwards co-current-wise through the main washing zone or through parts of this zone between the different screening stages. It is also possible to control the washing process so that the washing liquid from the conduits 9, 16 and 11 is spread substantially entirely radially, in which case the liquid in the pulp column in the main washing zone 3 is staionary. In this case the washing in the main washing zone is done primarily by diffusion. It is also possible to control the washing process so that a certain part of the washing liquid moves in controlled counter-current flow upwards through the conduits 17, 16 outside the pulp column.

Figure 2:
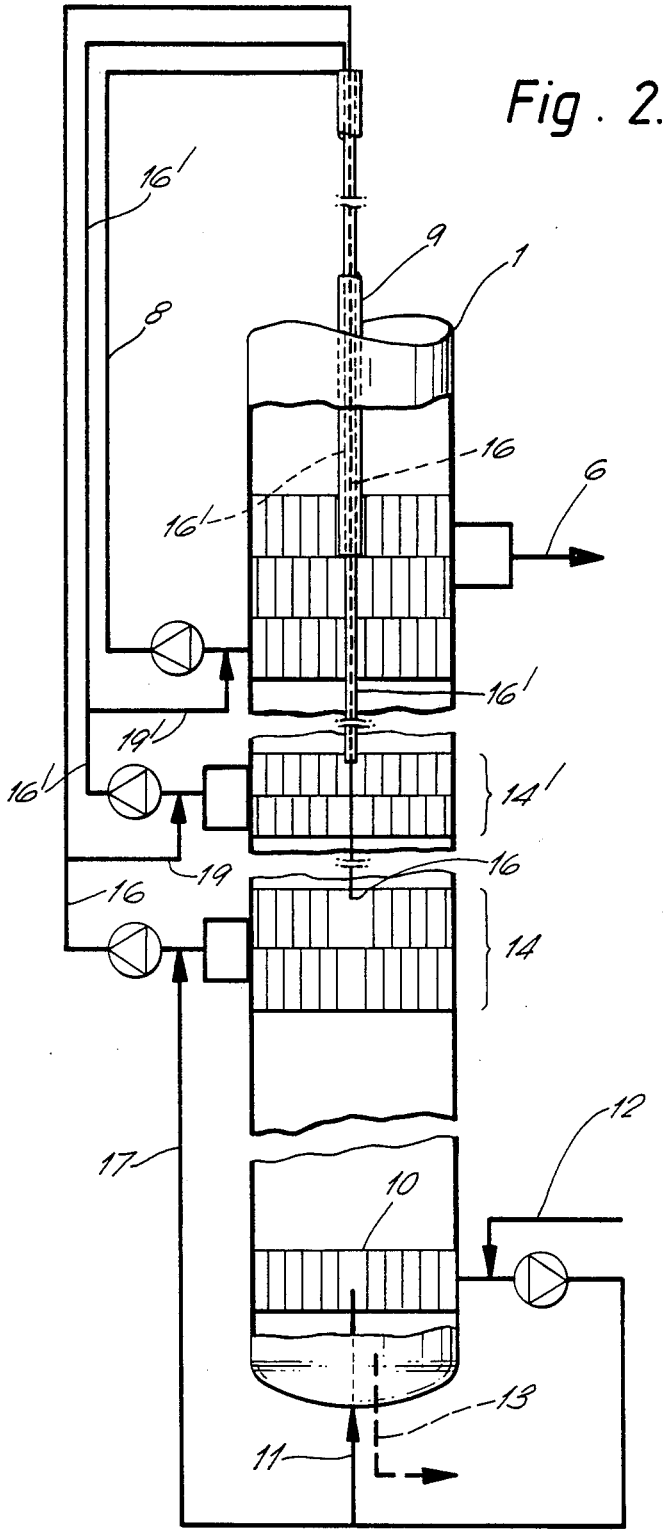
FIG. 2 is a vertical cross section of the equipment according to a second preferred embodiment of the invention.

In FIG. 2 a washing device is illustrated, where still another intermediate screening stage has been included in the main washing zone. From the screen girdles 15' of screening stage 14' washing liquid is recirculated via a recirculation conduit 16' after mixing with cleaner washing liquid from the washing stage 14 below, which is sent in counter-current flow through conduits 16 and 19. Thus, washing is carried out in analogy with the manner described in connection with FIG. 1, in other words in zones of diffusion in alternation with screening stages where washing liquid is entered, said washing liquid having been transported in counter-current outside the pulp column.

I claim:

1. Method of washing delignified pulp in a continuous pulp cooking vertical, elongated pressure vessel including an upper cooking zone, a main washing zone, a diluting and cooling zone at the bottom of said vessel, an interruption zone located between the cooking zone and the main washing zone, and at least four screen girdles located in the vessel, said method comprising:

cooking wood chips in contact with cooking liquor to produce pulp and passing pulp containing spent cooking liquor downward in said vessel, removing a portion of spent cooking liquor from said pulp in the interruption zone by displacement by a first washing liquid to remove the spent cooking liquor through at least a first screen girdle in the interruption zone to obtain a first removed liquid, removing a portion of said first washing liquid through at least a second screen girdle provided below said first screen girdle in the interruption zone to obtain a second removed liquid, passing the pulp containing washing liquid downward through the main washing zone towards the diluting and cooling zone while contaminating the washing liquid with spent cooking liquor from the pulp, so as to render the spent cooking liquor displaceable from the pulp, removing a portion of the contaminated washing liquid in the main washing zone through at least a thrid screen girdle located in the main washing zone by displacement by a second washing liquid, which is cleaner than said first washing liquid, to obtain a third removed liquid, displacing at least a portion of the remaining contaminated washing liquid in the diluting and cooling zone by a first portion of a third washing liquid, which is cleaner than said first and second washing liquids, to remove the contaminated washing liquid through at least a fourth screen girdle in the diluting and cooling zone, to obtain a fourth removed liquid, combining said third removed liquid with at least one of said third washing liquid and said fourth removed liquid to obtain said second washing liquid, passing a first portion of the combined second washing liquid out of contact with the pulp to the region of the third screen girdle, introducing said first portion of said combined second washing liquid centrally into the vessel in the region of said third screen girdle to pass said combined second washing liquid radially outward toward said third screen girdle, combining a second portion of said combined second washing liquid with said second removed liquid to obtain said first washing liquid, and recirculating said combined first washing liquid to the interruption zone.

2. Method of claim 1, wherein at least a part of the first washing liquid which is introduced into said vessel in the interruption zone accompanies the pulp in co-current flow downward to said third screen girdle in the main washing zone, during which transport the pulp is washed by diffusion.

3. Method according to claim 1, wherein the first washing liquid introduced into said vessel in the interruption zone is distributed generally radially toward at least one of said first and second screen girdles in the interruption zone.

4. Method of claim 2, wherein the liquid in the pulp between the interruption zone and the third screen girdle is substantially stationary, with the pulp being washed during transportation through said stationary liquid region by diffusion.

5. Method according to claim 1, wherein the washing liquid in at least a portion of the main washing zone passes upwards in counter-current flow to the downwardly progression pulp, while another portion of the washing liquid is being passed through at least one separate conduit in a direction which is counter-current to the pulp flow.

6. Method of claim 1, wherein a plurality of intermediate screening stages are provided between the interruption zone and the diluting and cooling zone, with washed liquid removed from the vessel through the intermediate screening stages, with the washing liquid so removed at least partly being passed in counter-current flow to, but not through, the pulp to a vertically higher intermediate screening stage, to enter the pulp in an axially central location to pass radially toward that intermediate screening stage.

* * * * *